US011633965B2

(12) United States Patent
Tsuji

(10) Patent No.: US 11,633,965 B2
(45) Date of Patent: Apr. 25, 2023

(54) PRINTER

(71) Applicant: BROTHER KOGYO KABUSHIKI KAISHA, Nagoya (JP)

(72) Inventor: Takuya Tsuji, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/412,432

(22) Filed: Aug. 26, 2021

(65) Prior Publication Data

US 2022/0063308 A1 Mar. 3, 2022

(30) Foreign Application Priority Data

Aug. 31, 2020 (JP) ..... JP2020-146282

(51) Int. Cl.
*B41J 11/70* (2006.01)
*B41J 11/44* (2006.01)
*B41J 15/04* (2006.01)

(52) U.S. Cl.
CPC ..... *B41J 11/70* (2013.01); *B41J 11/44* (2013.01); *B41J 15/048* (2013.01)

(58) Field of Classification Search
None
See application file for complete search history.

(56) References Cited

U.S. PATENT DOCUMENTS 7,887,038 B2 * 2/2011 Shigeno ..... B65H 3/0684 271/9.08
9,199,821 B2 * 12/2015 Nunokawa ..... B65H 3/44
2010/0213664 A1 * 8/2010 Murray ..... B65H 3/0669 271/109

FOREIGN PATENT DOCUMENTS

JP 2018-186448 A 11/2018

* cited by examiner

*Primary Examiner* — Leslie J Evanisko
(74) *Attorney, Agent, or Firm* — Scully, Scott, Murphy & Presser, PC

(57) ABSTRACT

A printer includes a first accommodating portion, a supply roller, a recording device, a cutter configured to cut a recording medium into a first recording medium and a second recording medium, a second accommodating portion, a third accommodating portion that accommodates an unrecorded second recording medium that is the second recording medium on which an image has not been recorded by the recording device, and a switcher. The third accommodating portion is movable between a first position at which the third accommodating portion receives the unrecorded second recording medium cut by the cutter and a second position at which the unrecorded second recording medium accommodated in the third accommodating portion is in contact with the supply roller. The supply roller is configured to supply the unrecorded second recording medium accommodated in the third accommodating portion that is positioned at the second position.

19 Claims, 12 Drawing Sheets

PRINTER

CROSS REFERENCE TO RELATED APPLICATION

The present application claims priority from Japanese Patent Application No. 2020-146282, which was filed on Aug. 31, 2020, the disclosure of which is herein incorporated by reference in its entirety.

BACKGROUND

The following disclosure relates to a printer.

There has been a conventional image forming apparatus configured to form an image on a second sheet that is larger than a first sheet in size when the first sheet designated by a job is not accommodated in a first supply tray. In this image forming apparatus, after forming the image on the second sheet accommodated in a second supply tray, the image forming apparatus generates a recorded sheet on which the image is formed and an unrecorded sheet on which the image is not formed by cutting the large second sheet into two equal sheets in size.

Then, the unrecorded sheet is conveyed to the first supply tray, while the recorded sheet is discharged to a first discharge tray. This enables the image forming apparatus to form an image on the cut unrecorded sheet accommodated in the first supply tray when a sheet equal to the first sheet in size is designated by a next job.

SUMMARY

The conventional image forming apparatus, however, needs to provide a supply roller for each of the first supply tray and the second supply tray in order to use the cut unrecorded sheet, making it difficult to minimize the image forming apparatus in size.

An aspect of the disclosure relates to a minimized printer capable of using a recording medium that has been cut.

In one aspect of the disclosure, a printer includes a first accommodating portion that accommodates a recording medium, a supply roller configured to supply the recording medium to a conveyance path, a recording device configured to record an image on the recording medium supplied to the conveyance path by the supply roller, a cutter configured to cut the recording medium into a first recording medium and a second recording medium, a second accommodating portion that accommodates a recorded first recording medium and a recorded second recording medium, the recorded first recording medium being the first recording medium on which an image has been recorded by the recording device, the recorded second recording medium being the second recording medium on which an image has been recorded by the recording device, a third accommodating portion that accommodates an unrecorded second recording medium that is the second recording medium on which an image has not been recorded by the recording device, and a switcher configured to switch a conveyance destination of the second recording medium between the second accommodating portion and the third accommodating portion. The third accommodating portion is movable between a first position at which the third accommodating portion receives the unrecorded second recording medium cut by the cutter and a second position at which the unrecorded second recording medium accommodated in the third accommodating portion is in contact with the supply roller. The supply roller is configured to supply the unrecorded second recording medium accommodated in the third accommodating portion that is positioned at the second position.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

First Embodiment

Configuration of Printer

Figure 1:
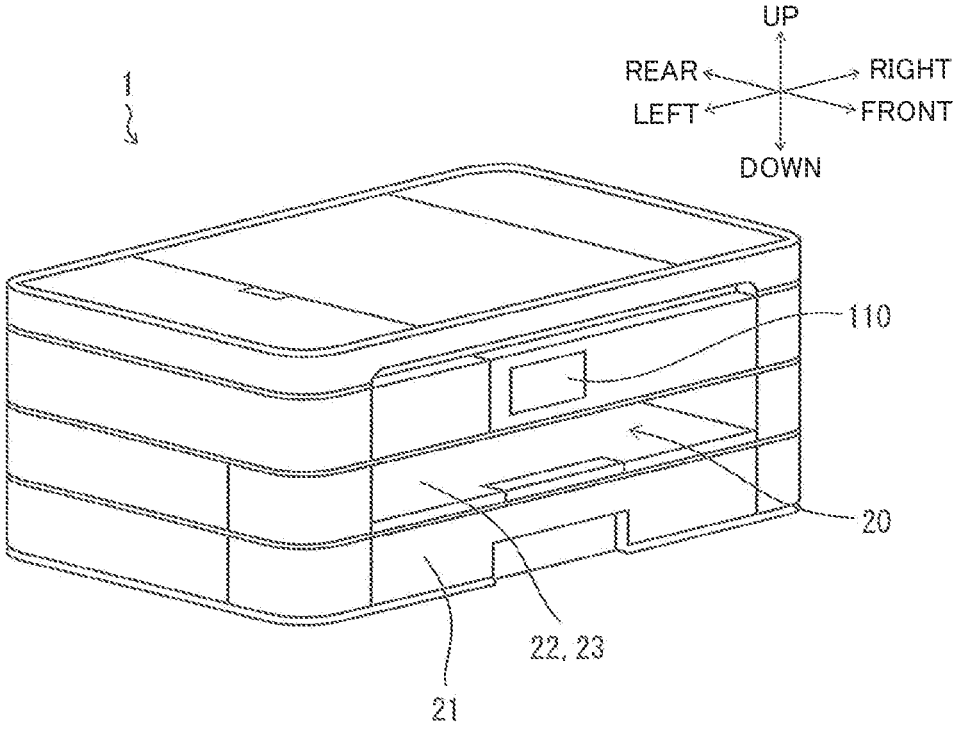
FIG. 1 is a perspective view illustrating an external appearance of a printer according to a first embodiment.
Figure 2:
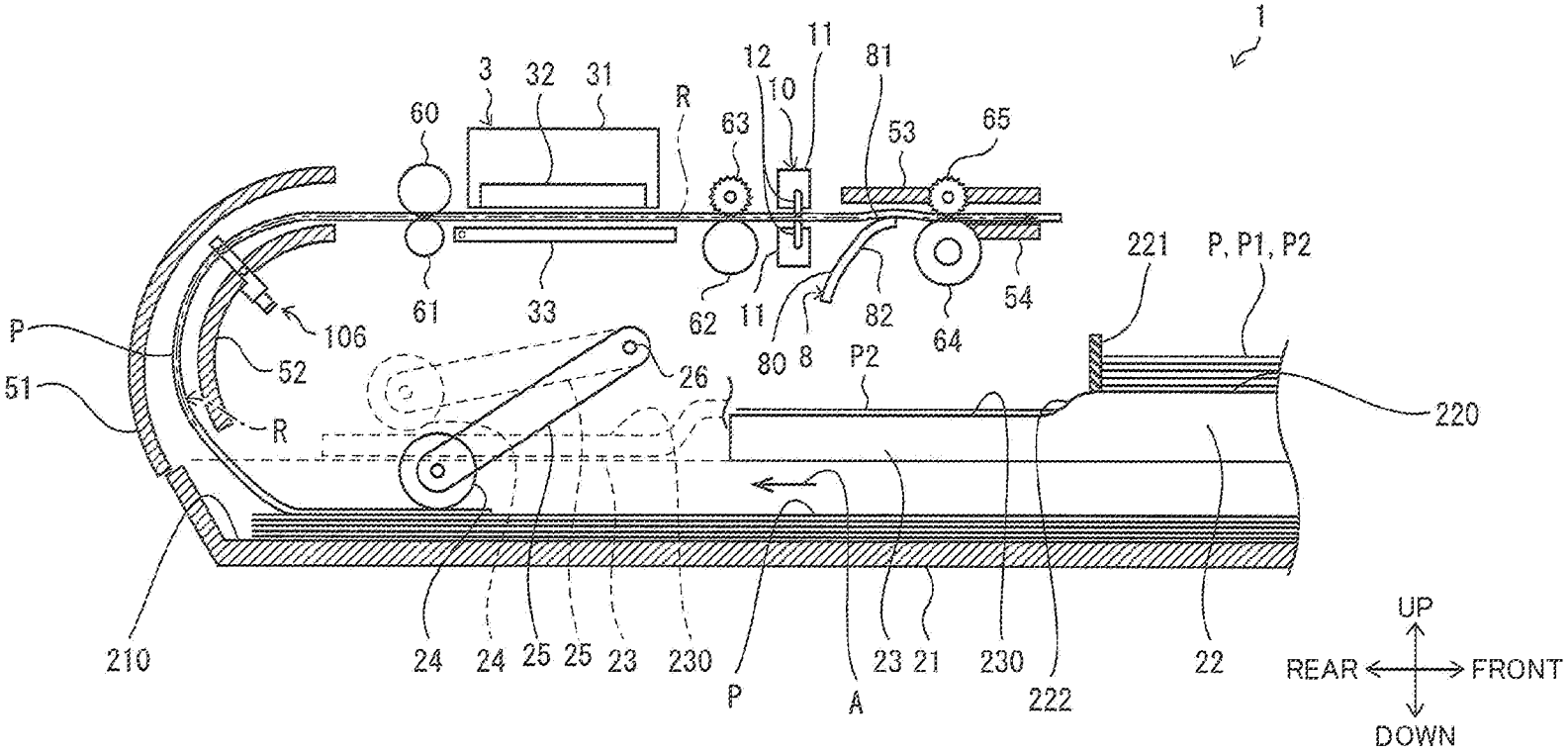
FIG. 2 is a cross-sectional view illustrating an inner configuration of the printer according to the first embodiment.

There will be described a printer 1 of a first embodiment of this disclosure, with reference to FIGS. 1 to 10. FIG. 1 is a perspective view illustrating an external appearance of the printer 1 according to a first embodiment. FIG. 2 is a cross-sectional view illustrating an inner configuration of the printer 1. The printer 1 illustrated in FIG. 1 is a MFP (Multi-Function Peripheral) having a plurality of functions such as a printing function, a scanner function, a copy function, and a facsimile function. It is noted that, for convenience of explanation, an up and down direction, a left and right direction, and a front and rear direction of the printer 1 are defined by arrows illustrated in FIG. 1.

The printer 1 has the printing function as an ink-jet printing type configured to record an image corresponding to image data designated by a job on a recording sheet, which is one example of a recording medium, by ejecting ink droplet onto the recording sheet, for example. The printer 1 is capable of printing the image on the recording sheet P by color printing, but may be specialized to black and white printing. The recording medium is not limited to a paper sheet, but may be a resin sheet used by an overhead projector, for example.

As illustrated in FIG. 1, an opening 20 is formed in a front surface of the printer 1. In the opening 20, a first accommodating portion 21, a second accommodating portion 22, and a third accommodating portion 23 are disposed so as to be attachable and detachable. The first accommodating portion 21 is a supply tray for accommodating a plurality of recording sheets P, and the first accommodating portion 21 opens upward. The first accommodating portion 21 includes a placement surface 210, and accommodates the plurality of recording sheets P placed on the placement surface 210. A size of the recording sheet P is the A4 size, for example. The second accommodating portion 22 and the third accommodating portion 23, which will be described below, are disposed above the first accommodating portion 21.

As illustrated in FIG. 1, a setting device 110 having a display screen is provided on the front surface of the printer 1. The setting device 110, for example, is constituted by a touch screen, and the setting device 110 is capable of setting various setting items related to printing of the printer 1 by a touch operation by a user. The setting device 110 receives a setting indicating the size of the recording sheet P and a setting of whether a cutting process is executed or not. Information set by the setting device 110 is output to a controller 100 (see FIG. 4).

As illustrated in FIG. 2, the printer 1 includes a supply roller 24, a conveyance path R, a resist roller 60, an image recording device 3, a first conveying roller 62, a second conveying roller 64, a cutter 10, and a switcher 8.

The supply roller 24 is a roller configured to supply the recording sheet P accommodated in the first accommodating portion 21 to the conveyance path R. The supply roller 24 is further configured to supply a second recording sheet P2, which is an unrecorded sheet and accommodated in the third accommodating portion 23, which will be described below, to the conveyance path R in a state in which the third accommodating portion 23 is positioned at a second position. The second recording sheet P2, which is an unrecorded second recording sheet P2, is a sheet which has been cut from a recorded recording sheet on which an image has been recorded and corresponds to a region of the recorded sheet on which any images are not recorded.

The supply roller 24 is rotatably supported at a distal end of a supply arm 25. The supply arm 25 is supported by an axis 26 supported by a frame of the printer 1 so as to be pivotable about the axis 26. An urging force of a self-weight of the supply arm 25 or an elastic force of a spring, for example, pivotably presses the supply arm 25 against the first accommodating portion 21.

Figure 4:
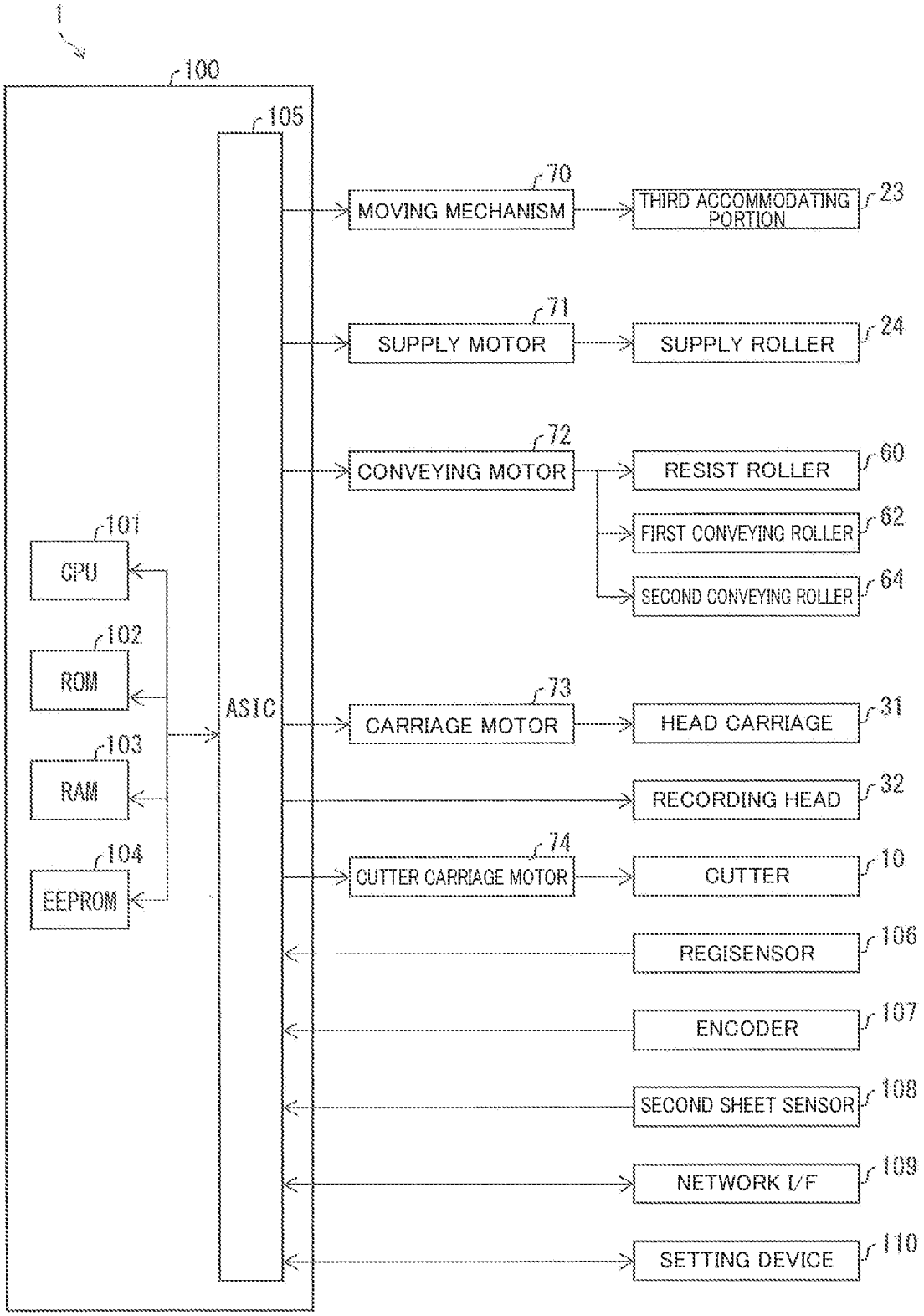
FIG. 4 is a block diagram illustrating an electrical configuration of the printer according to the first embodiment.
Figure 7:
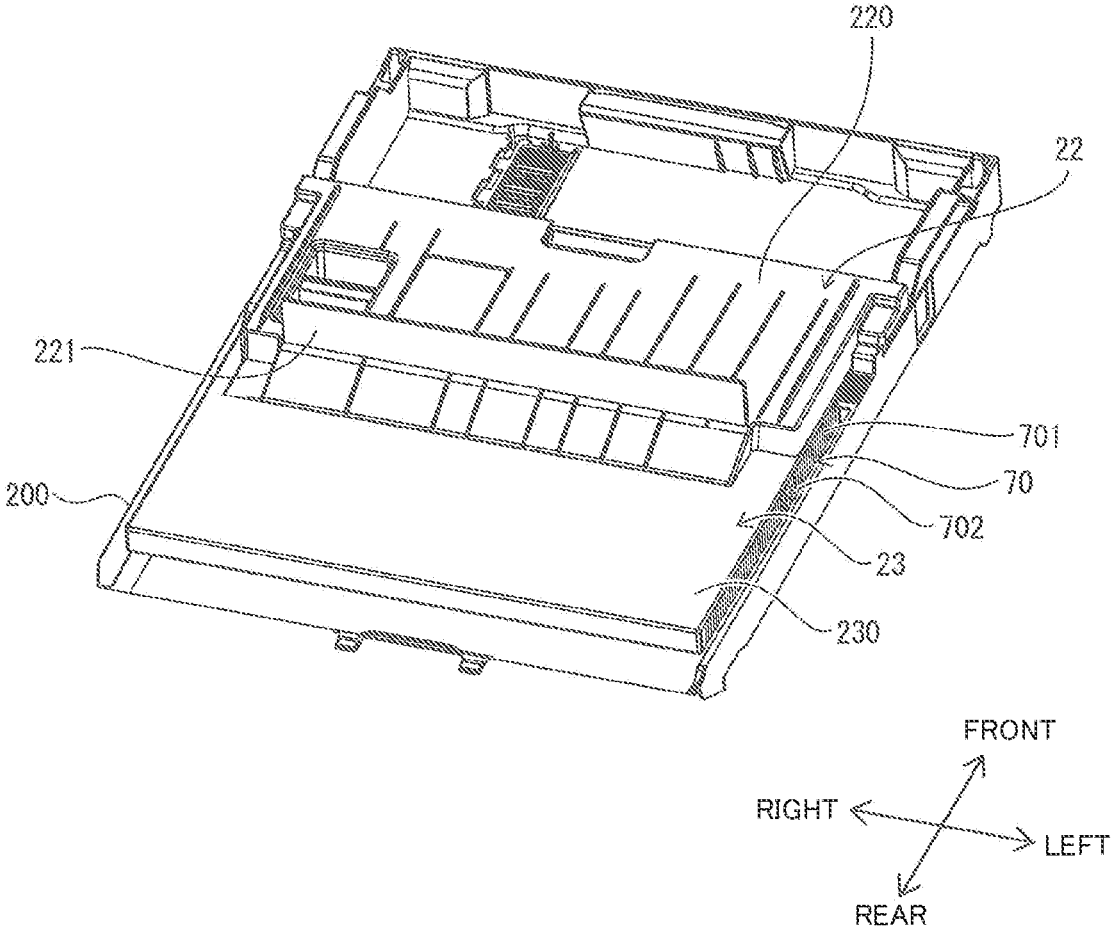
FIG. 7 is a view corresponding to the view in FIG. 3 when the third accommodating portion is positioned at a second position.

The supply roller 24 rotates in a forward direction, as an example of a first direction, by driving of a supply motor 71 (see FIG. 4). The recording sheet P accommodated in the first accommodating portion 21 is supplied to the conveyance path R one by one by rotation in the forward direction of the supply roller 24. As illustrated in FIG. 7, when the third accommodating portion 23 is positioned at the second position, the unrecorded second recording sheet P2 accommodated in the third accommodating portion 23 is supplied to the conveyance path R one by one. The recording sheet P or the unrecorded second recording sheet P2 supplied to the conveyance path R is conveyed in a direction directed from a front side toward a rear side of the printer 1.

The conveyance path R is a space defined by guide members 51, 52, 53, 54, the image recording device 3, and the like. The conveyance path R is a path which extends upward from a rear end of the first accommodating portion 21 and curves in a region defined by the guide members 51, 52. The conveyance path R extends straight in a region defined by the guide member 53, 54 after passing through a position of the image recording device 3, and reaches the second accommodating portion 22.

The resist roller 60 is disposed upstream of the image recording device 3 in the conveyance path R in a conveying direction of the recording sheet P. A pinch roller 61 is disposed at a position opposed to a lower portion of the resist roller 60. The resist roller 60 is driven by a conveying motor 72 (see FIG. 4). The pinch roller 61 is rotated by rotation of the resist roller 60. The recording sheet P is conveyed to the image recording device 3 by forward rotation of the resist roller 60 and the pinch roller 61 while the recording sheet P is nipped by the resist roller 60 and the pinch roller 61.

The resist roller 60 is provided with an encoder 107 configured to detect rotation of the resist roller 60 (see FIG. 4). The encoder 107 outputs a pulse signal in accordance with rotation of the resist roller 60 to the controller 100.

A regisensor 106 is attached to the guide member 52 at a position upstream of the resist roller 60 in the conveyance path R. The regisensor 106 is a sensor configured to detect that the recording sheet P has passed a contact position with the resist roller 60. A sensor having an actuator configured to swing by contact with the recording sheet P or a photosensor may be used as the regisensor 106, for example. The regisensor 106 outputs an ON signal in a state in which the recording sheet P is passing through the contact position with the resist roller 60 and outputs an OFF signal in a state in which the recording sheet P is not passing through the contact position with the resist roller 60. The detected signal by the regisensor 106 is output to the controller 100.

The image recording device 3 is disposed between the resist roller 60 and the first conveying roller 62 in the conveyance path R, and configured to record an image on the recording sheet P. The image recording device 3 includes a head carriage 31, a recording head 32, and a platen 33. The recording head 32 is mounted on the head carriage 31. A plurality of nozzles, which are not illustrated, are provided on a lower surface of the recording head 32. The recording head 32 ejects ink droplets from the plurality of nozzles by vibrating a plurality of vibrating elements such as a plurality of piezoelectric elements. The platen 33 is a member shaped like a rectangular plate on which the recording sheet P is placed. The recording head 32 selectively ejects ink droplets on the recording sheet P while the head carriage 31 moves with respect to the recording sheet P supported by the platen 33. As a result, an image is recorded on the recording sheet P.

The head carriage 31 reciprocates in a scanning direction by driving force transmitted from a carriage motor 73 (see FIG. 4). The controller 100 of the printer 1 repeats a recording process and a line-feed process in image printing on the recording sheet P. The recording process is a process in which the recording head 32 ejects ink droplets while the head carriage 31 moves in the scanning direction in a state in which a conveyance of the recording sheet P is stopped, and an image corresponding to one line (one scanning of the head carriage 31) is recorded on the recording sheet P. The line-feed process is a process in which the recording sheet P is conveyed by a predetermined amount of line-feed by driving the resist roller 60 and the first conveying roller 62.

The first conveying roller 62 is disposed downstream of the image recording device 3 in the conveying direction of the recording sheet P in the conveyance path R. A spur roller 63 is disposed at a position opposed to an upper portion of the first conveying roller 62. The first conveying roller 62 is driven by the conveying motor 72 (see FIG. 4). The spur roller 63 is rotated by rotation of the first conveying roller 62. The recording sheet P is conveyed to the cutter 10, which will be described below, by forward rotation of the first conveying roller 62 and the spur roller 63 while the recording sheet P is nipped by the first conveying roller 62 and the spur roller 63.

The cutter 10 is disposed between the first conveying roller 62 and the second conveying roller 64 in the conveyance path R. The cutter 10 includes a cutter carriage 11 and a blade 12, and the cutter 10 cuts the recording sheet P on which image has been recorded by the image recording device 3. The cutter carriage 11 moves in the scanning direction orthogonal to the conveying direction of the recording sheet P by driving force transmitted from a cutter carriage motor 74 (see FIG. 4).

The cutter 10 cuts, by the blade 12, the recording sheet P in a widthwise direction at a predetermined position of the recording sheet P by movement of the cutter carriage 11 in the scanning direction with respect to the recording sheet P which is stopped while being nipped by the first conveying roller 62 and the second conveying roller 64.

Figure 5:
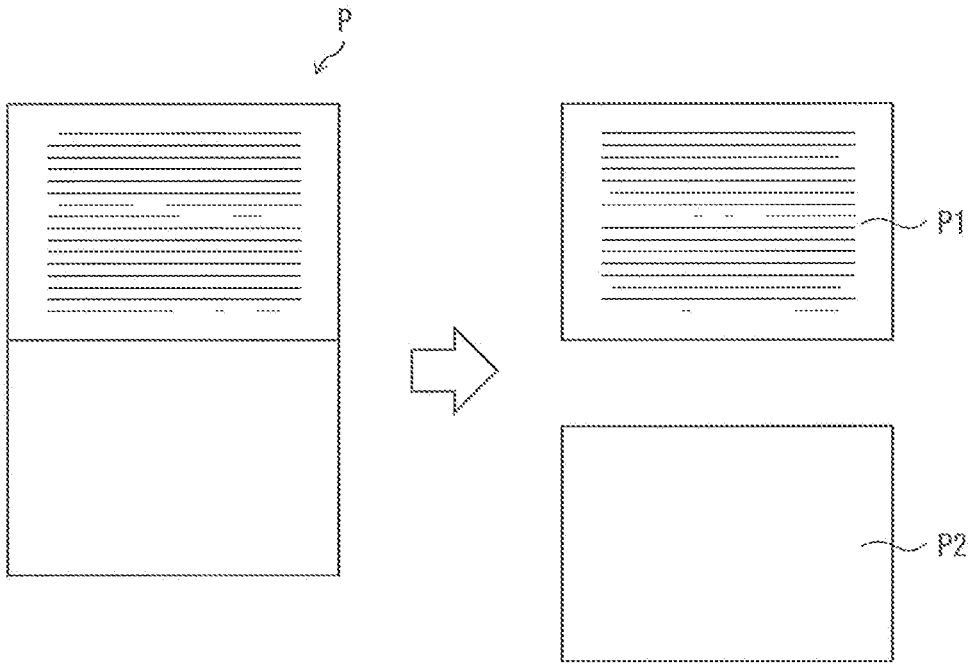
FIG. 5 is a view illustrating a recording sheet before cutting and a first recording sheet and a second recording sheet after cutting.

In the first embodiment, when the controller 100 determines that the recording sheet P needs to be cut, the cutter 10 cuts the recording sheet P into a first recording sheet P1 as an example of a first recording medium and the second recording sheet P2 as an example of a second recording medium by cutting the recording medium P at the predetermined position, as illustrated in FIG. 5. A size of the first recording sheet P1 and the second recording sheet P2 is an A5 size, for example.

The second conveying roller 64 is disposed downstream of the cutter 10 in the conveying direction of the recording sheet P in the conveyance path R. A spur roller 65 is disposed at a position opposed to an upper portion of the second conveying roller 64. The second conveying roller 64 is driven by the conveying motor 72 (see FIG. 4). The spur roller 65 is rotated by rotation of the second conveying roller 64. The recording sheet P, the first recording sheet P1, or the second recording sheet P2, each on which the image has been recorded, is discharged to the second accommodating portion 22 by forward rotation of the second conveying roller 64 and the spur roller 65 while the recording sheet P, the first recording sheet P1, or the second recording sheet P2 is nipped by the second conveying roller 64 and the spur roller 65.

The switcher 8 is disposed between the first conveying roller 62 and the second conveying roller 64 in the conveyance path R. The switcher 8 is a member configured to switch a conveyance destination of the second recording sheet P2 between the second accommodating portion 22 and the third accommodating portion 23. The switcher 8 is a member including a curved portion 80 which extends in a direction directed from an upper portion toward a lower portion of the printer 1 and curves toward the cutter 10. In other words, the switcher 8 is a member including a curved portion 80 which curves so as to be nearer to the cutter 10 at a lower portion of the curved portion 80 than at an upper portion of the curved portion 80. The switcher 8 guides the unrecorded second recording sheet P2 on which an image has not been recorded to the third accommodating portion 23 that is positioned at a first position, which will be described below, along the curved portion 80.

Figure 6:
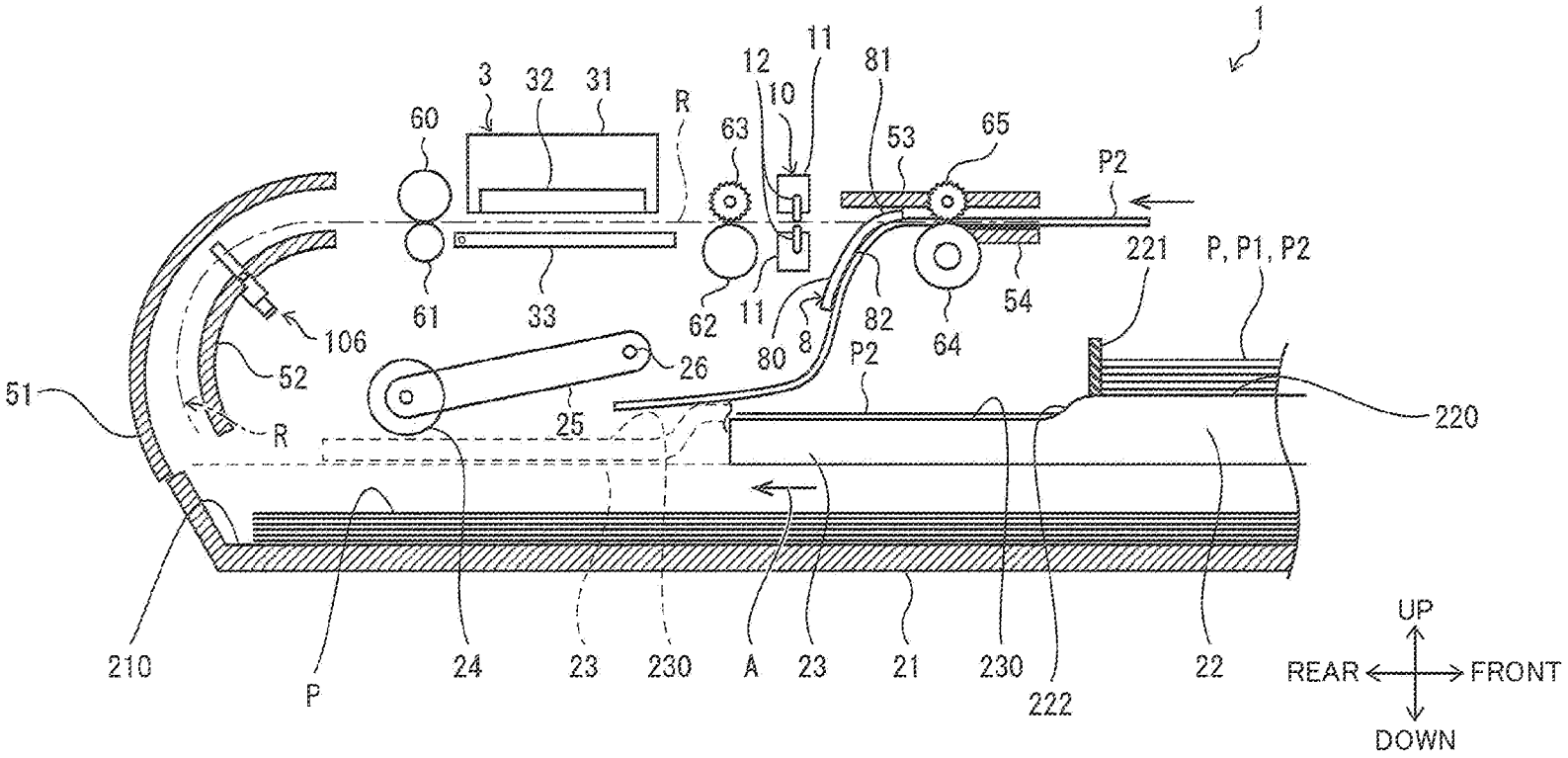
FIG. 6 is a view corresponding to the cross-sectional view in FIG. 2 when the second recording sheet is conveyed to the third accommodating portion.

The switcher 8 includes a first guide surface 81 that guides the recording sheet P to the second accommodating portion 22 and a second guide surface 82 that guides the unrecorded second recording sheet P2 on which an image has not been recorded to the third accommodating portion 23. The switcher 8 is disposed so as to be pivotable between a first state at which, as illustrated in FIG. 2, the first guide surface 81 comes into contact with the recording sheet P and a second state at which, as illustrated in FIG. 6, the second guide surface 82 comes into contact with the unrecorded second recording sheet P2.

It is noted that the switcher 8 is provided with a urging member which is not illustrated. The urging member is constituted by a spring, for example, and the urging member pushes the switcher 8 toward the guide member 53.

Figure 3:
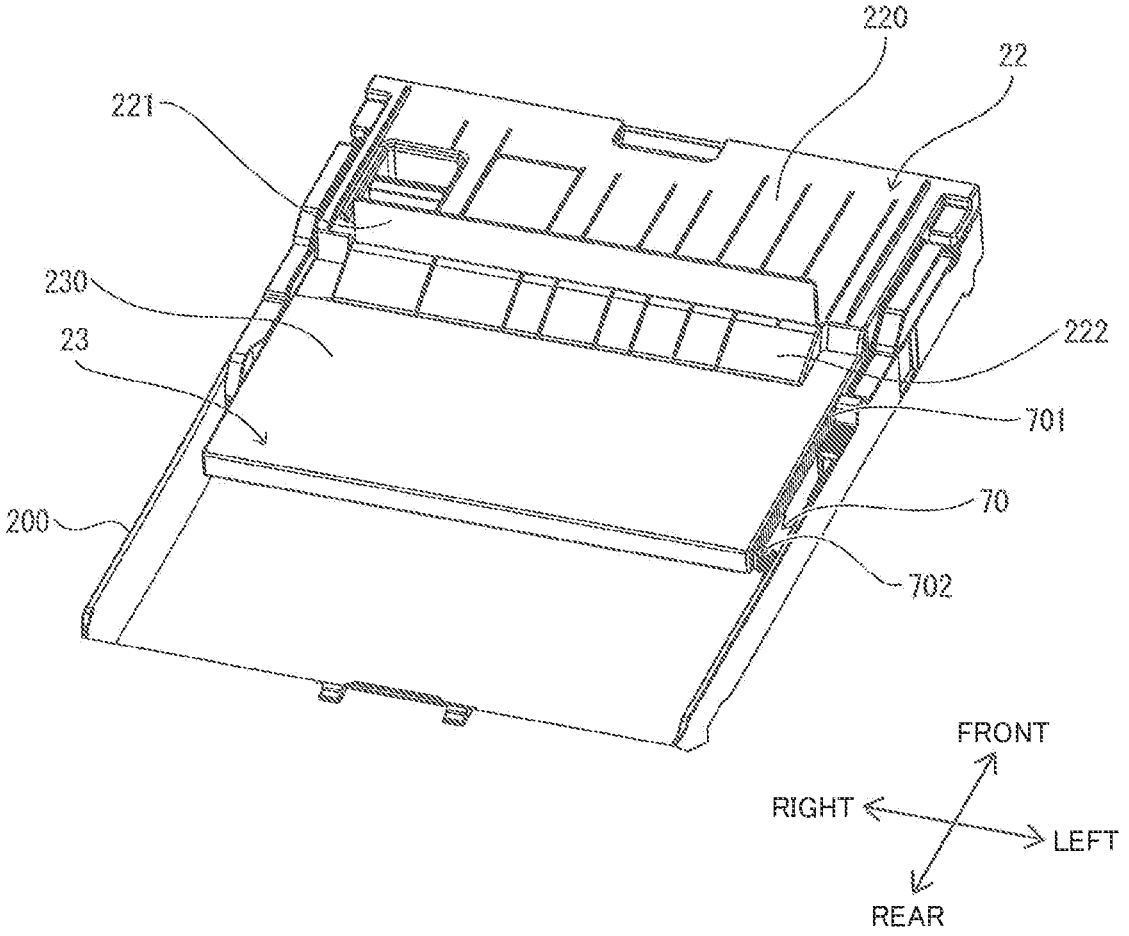
FIG. 3 is a perspective view illustrating configurations of a second accommodating portion and a third accommodating portion according to the first embodiment.

Detailed Configurations of Second Accommodating Portion and Third Accommodating Portion There will be next described in detail, with reference to FIG. 3, a configuration of the second accommodating portion 22 and the third accommodating portion 23. FIG. 3 is a perspective view illustrating configurations of the second accommodating portion 22 and the third accommodating portion 23 according to the first embodiment. As illustrated in FIG. 3, the second accommodating portion 22 and the third accommodating portion 23 are disposed in a frame member 200 and formed in one piece so as not to overlap each other when viewed from above the printer 1 in a vertical direction. Specifically, the second accommodating portion 22 is disposed at a front portion in the frame member 200. The third accommodating portion 23 is disposed at a rear portion in the frame member 200.

As illustrated in FIG. 2, the recording sheet P, the first recording sheet P1, and the recorded second recording sheet P2, each on which an image has been recorded, are accommodated in the second accommodating portion 22. On the other hand, the unrecorded second recording sheet P2 on which an image has not been recorded is accommodated in the third accommodating portion 23. The unrecorded second recording sheet P2 is used in printing by a next job after being accommodated in the third accommodating portion 23. It is noted that at least one second recording sheet P2 may be accommodated in the third accommodating portion 23 in printing of the next job.

As illustrated in FIGS. 2 and 3, the second accommodating portion 22 includes a placement surface 220 and a protruding portion 221. The recording sheet P, the first recording sheet P1, and the second recording sheet P2, each on which an image has been recorded, are placed on the placement surface 220. The protruding portion 221 is a member shaped like a plate and extending upward from a one side edge nearer to the third accommodating portion 23 than the other side edge of the placement surface 220. The protruding portion 221 is the member shaped like a plate and preventing (a) the recording sheet P, the first recording sheet P1, and the second recording sheet P2, each on which an image had been recorded, and (b) the second recording sheet P2 on which an image has not been recorded in the third accommodating portion 23 from mixing up. The protruding portion 221 may be formed in one piece with the second accommodating portion 22, and may be attached so as to be attachable to and detachable from the second accommodating portion 22.

A step 222 inclined from the second accommodating portion 22 toward the third accommodating portion 23 downward is formed between the second accommodating portion 22 and the third accommodating portion 23. That is, the step is inclined so as to be higher at its front portion than at its rear portion. The step 222 formed between the second accommodating portion 22 and the third accommodating portion 23 enables the plurality of unrecorded second recording sheets P2 to be accommodated in the third accommodating portion 23.

The third accommodating portion 23 includes a placement surface 230 on which the unrecorded second recording sheet P2 on which an image has not been recorded is placed. The third accommodating portion 23 is disposed in the frame member 200 so as to be movable in a depth direction of the printer 1, which is a front and rear direction, between the first position illustrated in FIG. 3 and the second position illustrated in FIG. 7.

When the third accommodating portion 23 is positioned in the first position illustrated in FIG. 3, the third accommodating portion 23 is disposed above the first accommodating portion 21 and below the switcher 8, and the third accommodating portion 23 receives and accommodates the unrecorded second recording sheet P2 that has been cut from the recording sheet P. In a state in which the third accommodating portion 23 is positioned at the first position, the third accommodating portion 23 does not come into contact with the supply roller 24. On the other hand, as illustrated in FIG. 7, in a state in which the third accommodating portion 23 is positioned at the second position, the unrecorded second recording sheet P2 accommodated in the third accommodating portion 23 comes into contact with the supply roller 24.

A dimension of the third accommodating portion 23 in the depth direction of the printer 1, which is the front and rear direction, is less than a dimension of the first accommodating portion 21 in the depth direction which is the front and rear direction. Specifically, the dimension of the third accommodating portion 23 in the depth direction is equal to or less than a half of the dimension of the first accommodating portion 21 in the depth direction.

The third accommodating portion 23 includes a well-known moving mechanism 70. The moving mechanism 70 is constituted by a rack 701 illustrated in FIG. 3, a gear 702 geared with the rack 701, a rotation shaft which is not illustrated, a motor which is not illustrated, and the like. The rack 701 is formed on a left side surface of the third accommodating portion 23. The gear 702 is disposed at a predetermined position in the frame member 200, and coupled to the rotation shaft. The rotation shaft is rotated by driving of the motor, which is not illustrated. The third accommodating portion 23 is disposed so as to be slidable in the frame member 200 between the first position illustrated in FIG. 3 and the second position illustrated in FIG. 7 in accordance with rotation of the gear 702 by driving of the motor. As illustrated in FIG. 4, the controller 100 controls driving of the moving mechanism 70 to move the position of the third accommodating portion 23.

A second sheet sensor 108 as one example of a recording medium sensor is provided near the third accommodating portion 23. The second sheet sensor 108 is a sensor configured to detect whether there is the unrecorded second recording medium P2 or not in the third accommodating portion 23, and constituted by, for example, a photo-sensor having a light emitter and a light receiver. When there is the second recording sheet P2 in the third accommodating portion 23, the second sheet sensor 108 outputs an ON signal to the controller 100, and the second sheet sensor 108 outputs an OFF signal to the controller 100 when there is not the second recording sheet P2 in the third accommodating portion 23.

Electrical Configuration of Printer

FIG. 4 is a block diagram illustrating an electrical configuration of the printer 1 according to the first embodiment. As illustrated in FIG. 4, the printer 1 includes the controller 100 and a network interface (I/F) 109 as an example of a receiver in addition to the above described configurations.

The controller 100 includes a CPU (Central Processing Unit) 101, a ROM (Read Only Memory) 102, a RAM (Random Access Memory) 103, an EEPROM 104 (Registered trademark), and an ASIC 105, and these are connected to each other by an internal bus. The ROM 102 stores various programs and the like by which the CPU 101 controls various processing. The RAM 103 is used as a storage area temporary storing data and signals, or as a work area of data processing, which is used when the CPU 101 executes the programs. The EEPROM 104, as an example of a storage, stores information to be maintained even after a power of the printer 1 is turned off. The controller 100 controls the supply motor 71, the conveying motor 72, the carriage motor 73, the recording head 32, the cutter carriage motor 74, the setting device 110, and the like based on a control program read from the ROM 102.

The supply motor 71, the conveying motor 72, the carriage motor 73, the recording head 32, the cutter carriage motor 74, the regisensor 106, the encoder 107, the second sheet sensor 108, the network interface 109, and the setting device 110 are connected to the ASIC 105.

The ASIC 105 supplies a driving current to the supply motor 71, the conveying motor 72, the carriage motor 73, and the cutter carriage motor 74. The supply motor 71, the conveying motor 72, the carriage motor 73, and the cutter carriage motor 74 are DC motors, rotation speed of each of which increases as the supplied driving current increases, and decreases as the supplied driving current decreases. The controller 100 controls rotation of each of the supply motor 71, the conveying motor 72, the carriage motor 73, and the cutter carriage motor 74 by a PWM (Pulse Width Modulation) control.

The controller 100 applies a driving voltage to the vibrating elements of the recording head 32 to eject ink droplets from the nozzles. The controller 100 detects a rotation amount of the resist roller 60 based on a pulse signal output from the encoder 107. The controller 100 detects that the recording sheet P has passed through the contact position with the resist roller 60 based on a detection signal output from the regisensor 106. After the ON signal is output from the regisensor 106, the controller 100 estimates a conveyance amount of the recording sheet P in the conveyance path R based on the pulse signal output from the encoder 107.

The network interface 109 is connected to a network such as a LAN, and enables the printer 1 to connect an external device on which the driver for the printer 1 has been installed. When the printer 1 receives a job via the network interface 109, the printer 1 records an image corresponding to printing data designated by the job on the recording sheet P. The job includes information related to printing such as a total number of printing pages.

Control Operations of Controller

Figure 8:
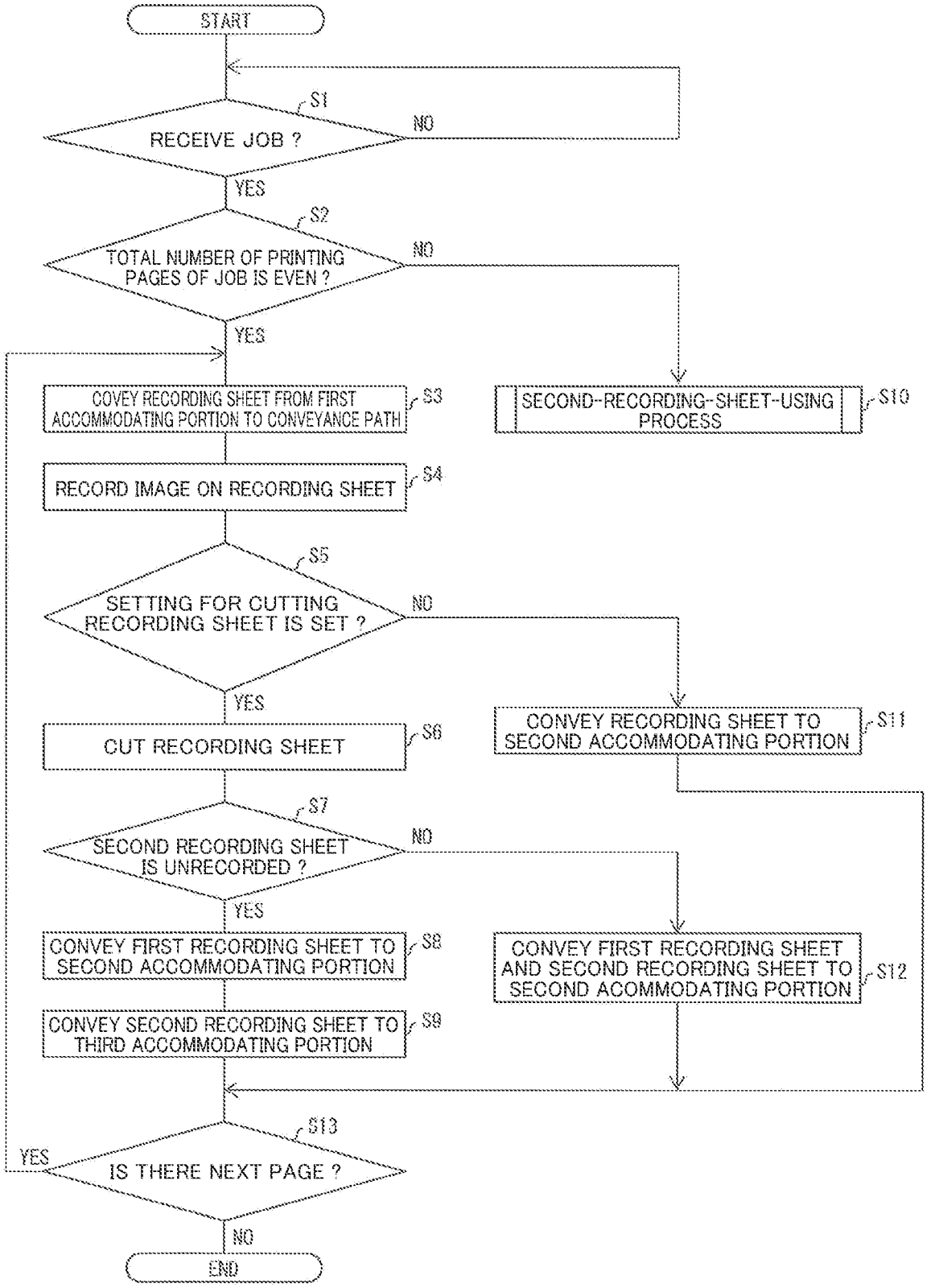
FIG. 8 is a flowchart illustrating a flow of control in printing by a controller of the printer according to the first embodiment.
Figure 9:
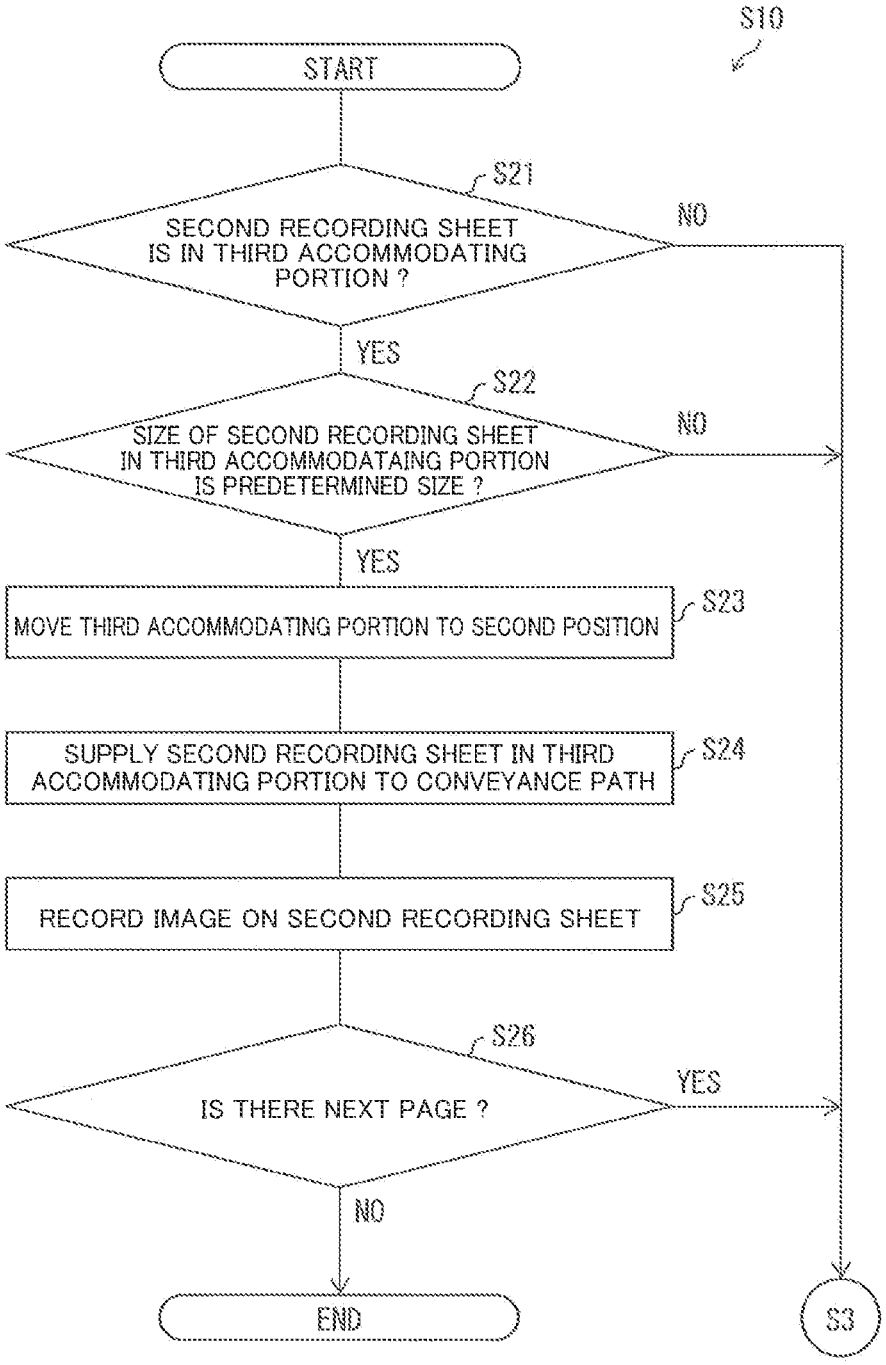
FIG. 9 is a flowchart illustrating a flow of a second-sheet-using process of the flowchart in FIG. 8.

There will be next described, with reference to flowcharts in FIGS. 8 and 9, a flow of control in printing by the controller 100 of the printer 1 according to the first embodiment. FIG. 8 is a flowchart illustrating a flow of control by the printer 1 according to the first embodiment. The flowchart illustrated in FIG. 8 is an example, and the present disclosure is not limited to this configuration.

In the flowchart illustrated in FIG. 8, first, the controller 100 determines whether the controller 100 receives the job (S1). When the controller 100 determines that the controller 100 receives the job via the network interface 109 (S1:YES), the controller 100 determines whether a total number of printing pages of the job is an even number (S2). When the controller 100 determines that the controller 100 does not receive the job (S1:NO), the flow returns to S1.

When the controller 100 determines that the total number of printing pages of the job is an even number (S2:YES), the controller 100 rotates the supply roller 24 in the forward direction by driving the supply motor 71 so as to convey the recording sheet P from the first accommodating portion 21 to the conveyance path R (S3). When a front end of the recording sheet P conveyed to the conveyance path R reaches the resist roller 60, the controller 100 rotates the resist roller 60, the first conveying roller 62, and the second conveying roller 64 in the forward direction by rotating the conveying motor 72 in the forward direction so as to convey the recording sheet P to the image recording device 3.

Next, the controller 100 executes an image recording process in which the line-feed process and the recording process, which will be described below, are repeated with respect to the recording sheet P that has been conveyed to the image recording device 3 so as to record an image on the recording sheet P (S4). That is, in the line-feed process, the controller 100 drives the resist roller 60, the first conveying roller 62, and the second conveying roller 64 by rotating the conveying motor 72 so as to convey the recording sheet P by a predetermined conveyance amount. In the recording process, the controller 100 controls the recording head 32 to eject ink droplets from the nozzle on the recording sheet P while the head carriage 31 moves in the scanning direction of the recording sheet P by driving the carriage motor 73 in a state in which a conveyance of the recording sheet P is stopped, and an image corresponding to one line (one scanning of the head carriage 31) is recorded on the recording sheet P.

On the other hand, when it is determined that the total number of printing pages of the job is not an even number (S2:NO), that is, the total number of printing pages of the job is an odd number, the controller 100 executes a second-sheet-using process illustrated in FIG. 9.

After S4, the controller 100 determines whether a setting for cutting the recording sheet P has been set by the setting device 110 (S5). When it is determined that the setting for cutting the recording sheet P has been set by the setting device 110 (S5:YES), the controller 100 cuts the recording sheet P by driving the cutter carriage motor 74 (S6). Specifically, the controller 100 cuts, by the blade 12, the recording sheet P in the widthwise direction at the predetermined position of the recording sheet P by movement of the cutter carriage 11 in the widthwise direction. On the other hand, when it is determined that the setting for cutting the recording sheet P has not been set by the setting device 110 (S5:NO), the controller 100 conveys the recording sheet P on which an image has been recorded to the second accommodating portion 22 (S11).

After S6, the controller 100 determines whether the second recording sheet P2 that has been cut from the recording sheet P by the cutter 10 at S6 is an unrecorded sheet (a recording sheet on which any images are not recorded) (S7). When it is determined that the second recording sheet P2 is an unrecorded sheet (S7:YES), the controller 100 conveys the first recording sheet P1 on which an image has been recorded to the second accommodating portion 22 (S8). Specifically, the controller 100 rotates the resist roller 60, the first conveying roller 62, and the second conveying roller 64 in the forward direction by controlling the conveying motor 72 so as to convey the first recording sheet P1 to the second accommodating portion 22. At this time, as illustrated in FIG. 2, the first recording sheet P1 is guided to the second accommodating portion 22 while contacting with the first guide surface 81 of the switcher 8, which is in the first state. At S8, it is noted that the first recording sheet P1 conveyed to the second accommodating portion 22 may be an unrecorded sheet on which an image has not been recorded.

Continuously, after a rear end of the unrecorded second recording sheet P2 has passed through the switcher 8, the controller 100 rotates the second conveying roller 64 in a reverse direction, which is opposite to the forward direction and an example of a second direction, by rotating the conveying motor 72 in the reverse direction so as to convey the second recording sheet P2 to the third accommodating portion 23 (S9). At this time, as illustrated in FIG. 6, since the switcher 8 is pushed toward the guide member 53 by the urging member, the second recording sheet P2 is guided to the third accommodating portion 23 while contacting with the second guide surface 82 of the switcher 8, which is in the second state, without being conveyed toward the cutter 10.

On the other hand, when it is determined that the second recording sheet P2 is not an unrecorded sheet (S7:NO), that is, when an image has been recorded on the second recording sheet P2, the controller 100 conveys the first recording sheet P1 and the second recording sheet P2 to the second accommodating portion 22 (S12).

After S9, S11 and S12, the controller 100 determines whether there is a next page of the job (S13). When it is determined that there is a next page of the job (S13:YES), the controller 100 execute a processing at S3. On the other hand, when it is determined that there is not a next page of the job (S13:NO), the flow illustrated in FIG. 8 ends.

There will be next described the second-sheet-using process at S10 in FIG. 8. FIG. 9 is a flowchart illustrating a flow of the second-sheet-using process (S10) in FIG. 8. As illustrated in FIG. 9, first, the controller 100 determines whether there is the unrecorded second recording sheet P2 in the third accommodating portion 23 based on an output from the second sheet sensor 108 (S21). When it is determined that there is the unrecorded second recording sheet P2 in the third accommodating portion 23 (S21:YES), the controller 100 determines whether a size of the unrecorded second recording sheet P2 accommodated in the third accommodating portion 23 is a predetermined size (S22). The predetermined size is a size of the recording sheet of printing data designated by the job.

When it is determined that the size of the unrecorded second recording sheet P2 accommodated in the third accommodating portion 23 is the predetermined size (S22:YES), the flow goes to S23. At S23, the controller 100 moves the second accommodating portion 22 and the third accommodating portion 23 in a direction defined by an arrow A in FIG. 2, that is a direction directed from the third accommodating portion 23 toward the supply roller 24 by driving the moving mechanism 70. The third accommodating portion 23 is moved from the first position in FIG. 3 to the second position in FIG. 7. On the other hand, when it is determined that there is not the unrecorded second recording sheet P2 in the third accommodating portion 23 (S21:NO), or when it is determined that the size of the unrecorded second recording sheet P2 accommodated in the third accommodating portion 23 is not the predetermined size (S22:NO), the controller 100 executes a processing at S3.

After S23, the controller 100 rotates the supply roller 24 in the forward direction by driving the supply motor 71 so as to convey the unrecorded second recording sheet P2 accommodated in the third accommodating portion 23 to the conveyance path R (S24). Then, the controller 100 rotates the resist roller 60, the first conveying roller 62, and the second conveying roller 64 in the forward direction by rotating the conveying motor 72 in the forward direction so as to convey the unrecorded second recording sheet P2 to the image recording device 3.

Next, the controller 100 records an image on the unrecorded second recording sheet P2 by the image recording device 3 (S25), and determines whether there is a next page of the job (S26). When it is determined that there is a next page of the job (S26:YES), the controller 100 executes a processing at S3 in FIG. 8. That is, in the first embodiment, in a case where the total number of printing pages of the job is an odd number and equal to or greater than three pages, the controller 100 supplies the recording sheet P accommodated in the first accommodating portion 21 to the conveyance path R to print an image for pages other than the first page (S3), and executes processing executed after S3. On the other hand, when it is determined that there is not a next page of the job (S26:NO), that is, when the total number of printing pages of the job is one page, the controller 100 ends the second-sheet-using process at S10 in FIG. 8.

It is noted that, at S2 in FIG. 8, when it is determined that the total number of printing pages of the job is an odd number (S2:NO), the controller 100 executes the second-sheet-using process at S10, however, the present disclosure is not limited to this configuration. For example, when it is determined that the total number of printing pages is an odd number and equal to or greater than three pages (S2:NO), first, the controller 100 may print an image for printing pages of the job other than the last page by executing processing executed at S3 and after S3 in FIG. 8, and then the controller 100 may execute the second-sheet-using process at S10 to print an image on the unrecorded second recording sheet P2 accommodated in the third accommodating portion 23 for the last page of the job.

Flow of Control in Power Off

Figure 10:
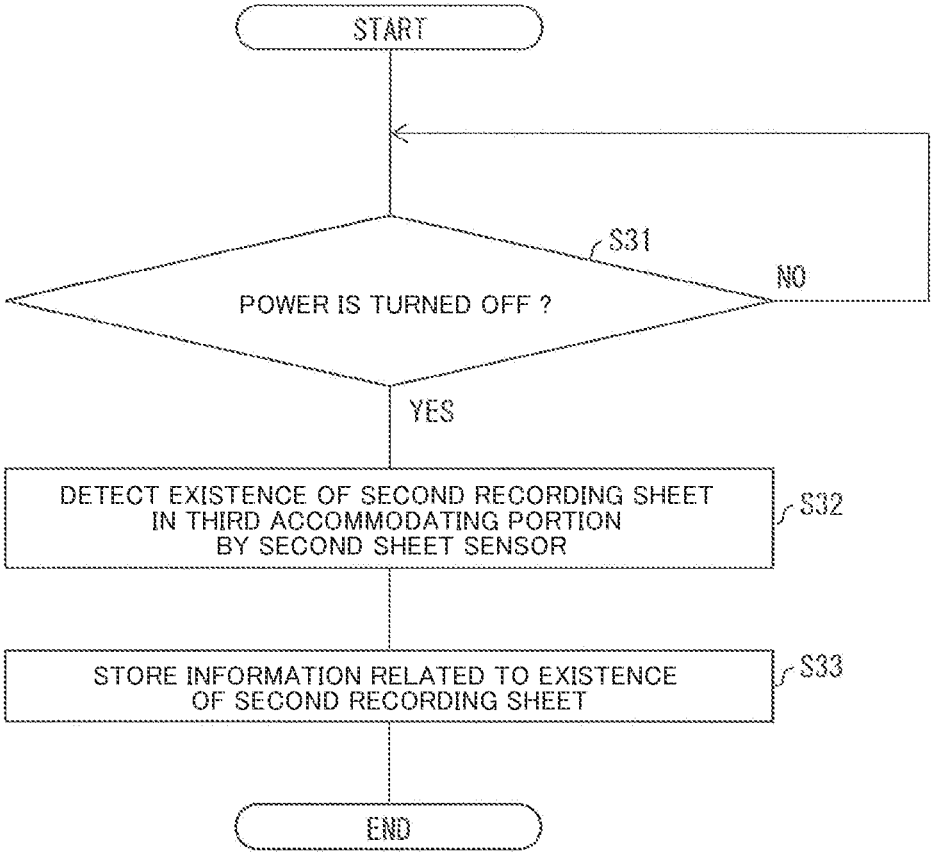
FIG. 10 is a flowchart illustrating a flow of control at a timing of a power off by the controller of the printer according to the first embodiment.

There will be next described a flow of control by the printer 1 at a timing of a power off according to the first embodiment, with reference to a flowchart in FIG. 10. FIG. 10 is a flowchart illustrating a flow of control at a timing of a power off by the controller 100 of the printer 1 according to the first embodiment. As illustrated in FIG. 10, the controller 100 determines at predetermined intervals whether a power of the printer 1 is turned off (S31). That is, the controller 100 continuously repeats a processing at S31 at the predetermined intervals when the power of the printer 1 is not turned off.

When it is determined that the power of the printer 1 is turned off by an operation of a user, for example (S31:YES), the controller 100 determines whether there is the unrecorded second recording sheet P2 in the third accommodating portion 23 by the second sheet sensor 108 (S32). Then, the controller 100 stores information related to an existence or a nonexistence of the unrecorded second recording sheet P2 into the EEPROM 104 as an example of a storage (S33), and the controller 100 ends the flowchart in FIG. 10.

Effects in First Embodiment

In the printer 1 according to the first embodiment, as described above, after cutting the recording sheet P into the first recording sheet P1 and the second recording sheet P2 by the cutter 10, the switcher 8 can switch the conveyance destination of the second recording sheet P2. Specifically, by the switcher 8, the unrecorded second recording sheet P2 on which an image has not been recorded can be conveyed to the third accommodating portion 23, while the recorded second recording sheet P2 on which an image had been recorded is conveyed to the second accommodating portion 22.

Then, in a next printing, the supply roller 24 provided for the first accommodating portion 21 is also used as the supply roller 24 for the third accommodating portion 23, and the unrecorded second recording sheet P2 accommodated in the third accommodating portion 23 is conveyed to the image recording device 3. An image can be recorded on the unrecorded second recording sheet P2. That is, it is possible to use the unrecorded second recording sheet P2 which has been cut from the recording sheet P. Additionally, there is no need to provide an additional supply roller dedicated to the third accommodating portion 23, resulting in reduction in size of the printer 1.

As indicated by the arrow A in FIG. 2, it is possible to bring the third accommodating portion 23 nearer to the supply roller 24 provided for the first accommodating portion 21 by moving the third accommodating portion 23 rearward of the printer 1 from the first position to the second position. This configuration enables the unrecorded second recording sheet P2 accommodated in the third accommodating portion 23 to be supplied to the conveyance path R by the supply roller 24 easily.

By automatically moving the third accommodating portion 23 from the first position to the second position by the controller 100, it is possible to smoothly use, in a next printing, the unrecorded second recording sheet P2 which has been cut.

The switcher 8 provided between the first conveying roller 62 and the second conveying roller 64 enables the third accommodating portion 23 to be disposed at a space below the first conveying roller 62 and the second conveying roller 64. It is possible to convey the unrecorded second recording sheet P2 to the third accommodating portion 23 by rotating the second conveying roller 64 in the reverse direction and bringing the unrecorded second recording sheet P2 into contact with the second guide surface 82. Accordingly, the conveyance destination of the second recording sheet P2 can be switched with this simple configuration.

The switcher 8 configured to pivot between the first state and the second state enables the conveyance destination of the second recording sheet P2 to be smoothly switched.

The protruding portion 221 extending upward from the one side edge of the second accommodating portion 22 of the placement surface 220 that is nearer to the third accommodating portion 23 than the other side edge is capable of separating the third accommodating portion 23 from the second accommodating portion 22. This configuration can prevent the user from taking out the unrecorded second recording sheet P2 by mistake when the user takes out the first recording sheet P1 from the second accommodating portion 22.

The controller 100 changes the flow of control in printing in accordance with an even number or an odd number that is the total number of printing pages designated by the job. That is, when it is determined that the total number of printing pages designated by the job is an even number (S2:YES), the controller records images corresponding to two pages on each of the recording sheets P without using the unrecorded second recording sheet P2 accommodated in the third accommodating portion 23 (S4), and then the controller 100 cuts the recording sheets P on which the images have been recorded. On the other hand, when it is determined that the total number of printing pages is an odd number (S2:NO), the controller 100 records an image corresponding to the first page of the job on the unrecorded second recording sheet P2 accommodated in the third accommodating portion 23 (S24), and then the controller 100 records images corresponding to pages other than the first page of the job on the recording sheet P accommodated in the first accommodating portion 21 (S4). This configuration enables the printer 1 to efficiently and promptly execute the image recording process.

The switcher 8 extending upward or downward of the printer 1 enables the unrecorded second recording sheet P2 on which an image has not been recorded to be successfully guided along the curved portion 80 of the switcher 8 to the third accommodating portion 23 provided below the cutter 10 without causing a jam and the like, as illustrated in FIG. 6.

When it is determined that the power of the printer 1 it turned off (S31:YES), the controller 100 stores the information related to the existence or the nonexistence of the unrecorded second recording sheet P2 accommodated in the third accommodating portion 23 detected by the second sheet sensor 108 into the EEPROM 104 as the storage (S33). This configuration enables the controller 100 of the printer 1 to promptly determine the existence or the nonexistence of the unrecorded second recording sheet P2 accommodated in the third accommodating portion 23 when the printer 1 is turned on in a next printing, and certainly use the unrecorded second recording sheet P2.

The length of the third accommodating portion 23 in the depth direction is less than that of the first accommodating portion 21 in the depth direction, resulting in reducing in size of the printer 1.

As illustrated in FIG. 2, since the third accommodating portion 23 is disposed so as to be slidable in the front and rear direction along an upper wall of the first accommodating portion 21, it is possible to successfully move a rear portion of the third accommodating portion 23 to a position of the supply roller 24. This configuration enables the unrecorded second recording sheet P2 accommodated in the third accommodating portion 23 to be certainly supplied to the conveyance path R by the supply roller 24.

In the state in which the third accommodating portion 23 is at the first position, the supply roller 24 does not come into contact with the second recording sheet P2. This configuration enables the supply roller 24 not to prevent the conveyance of the unrecorded second recording sheet P2 when the switcher 8 guides the unrecorded second recording sheet P2 to the third accommodating portion 23.

The second accommodating portion 22 and the third accommodating portion 23 that are formed in one piece enables the second accommodating portion 22 and the third accommodating portion 23 to be produced easily. The step 222 formed between the second accommodating portion 22 and the third accommodating portion 23 can prevent (a) the first recording sheet P1 and the recorded second recording sheet P2, each on which an image has been recorded, to be conveyed to the second accommodating portion 22 and (b) the unrecorded second recording sheet P2 on which an image has not been recorded to be conveyed to the third accommodating portion 23 from mixing up.

Second Embodiment

Configuration of Printer

Figure 11:
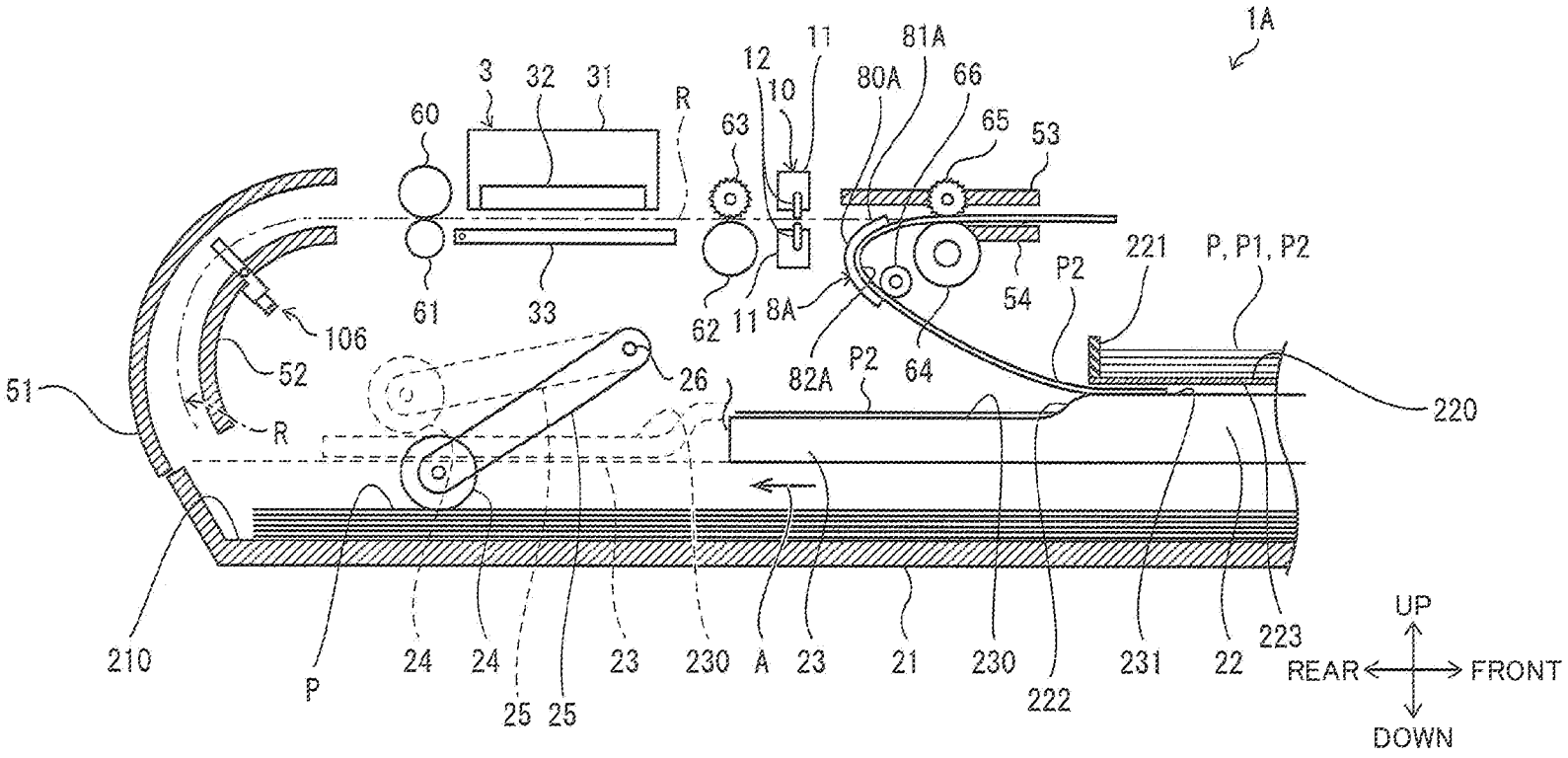
FIG. 11 is a view corresponding to the cross-sectional view in FIG. 2 illustrating a conveyance manner of the recording sheet of the printer according to a second embodiment.

There will be next described, with reference to FIG. 11, a printer 1A according to a second embodiment of the present disclosure. It is noted that the same reference numerals as used in the first embodiment are used to designate the corresponding elements of the second embodiment, and an explanation of which is dispensed with.

FIG. 11 is a cross-sectional view corresponding to the cross-sectional view in FIG. 2 illustrating a conveyance manner of the second recording sheet P2 of the printer 1A according to the second embodiment. As illustrated in FIG. 11, different from the printer 1 of the first embodiment, the printer 1A of the second embodiment is provided with a U-shaped switcher 8A and a third conveying roller 66, and a placement portion 231 provided below the placement surface 220 of the second accommodating portion 22.

The switcher 8A extends in a direction directed from an upper portion toward a lower portion of the printer 1A, and includes a curved portion 80A, a first guide surface 81A, and a second guide surface 82A. The curved portion 80A curves toward the cutter 10. That is, the curved portion 80A curves so as to be nearer to the cutter 10 at a lower portion of the curved portion 80A than at an upper portion of the curved portion 80A. The first guide surface 81A is configured to guide the recording sheet P to the second accommodating portion 22, and guide the first recording sheet P1 and the recorded second recording sheet P2 each on which an image has been recorded to the second accommodating portion 22.

The second guide surface 82A is configured to guide a front end of the unrecorded second recording sheet P2 to the placement portion 231, and then guide said unrecorded second recording sheet P2 to the third accommodating portion 23. It is noted that an urging force, which is not illustrated, pivotably pushes the switcher 8A toward the guide member 53.

The third conveying roller 66 is disposed near to a lower portion of the switcher 8A and at a side of the second guide surface 82A of the switcher 8A. When the third conveying roller 66 rotates in the forward direction, the front end of the unrecorded second recording sheet P2 is guided to the placement portion 231 along the second guide surface 82A.

The placement portion 231 is provided at a position below the placement surface 220 of the second accommodating portion 22 with a space therebetween. A partition wall 223 is provided between the placement portion 231 and the placement surface 220 of the second accommodating portion 22. A part of a front portion of the unrecorded second recording sheet P2 is placed on the placement portion 231. The placement portion 231 constitutes a part of the third accommodating portion 23.

Control Operations of Controller

There will be next described a flow of control in printing by the controller 100 of the printer 1A according to the second embodiment, which are only different points from the first embodiment. In the second embodiment, a processing at S9 in the flowchart in illustrated in FIG. 8 is different from the first embodiment.

In the second embodiment, after a rear end of the unrecorded second recording sheet P2 has passed through the switcher 8A, the controller 100, at S9, rotates the second conveying roller 64 in the reverse direction and rotates the third conveying roller 66 in the forward direction by rotating the conveying motor 72 in the reverse direction so as to convey the unrecorded second recording sheet P2 to the third accommodating portion 23 (S9).

Specifically, first, a front portion of the unrecorded second recording sheet P2 is conveyed to the placement portion 231 along the second guide surface 82A of the switcher 8A. At this time, as illustrated in FIG. 11, since the switcher 8A is pushed toward the guide member 53 by the urging member, the front portion of the unrecorded second recording sheet P2 is conveyed to the placement portion 231 while contacting with the second guide surface 82A of the switcher 8A without being conveyed toward the cutter 10. Then, the unrecorded second recording sheet P2 is conveyed to the third accommodating portion 23 by dropping due to self-weight.

According to the printer 1A of the second embodiment described above, it is possible to certainly covey the unrecorded second recording sheet P2 to the third accommodating portion 23 by the second conveying roller 64 and the third conveying roller 66.

Especially, the controller 100 conveys the unrecorded second recording sheet P2 to the third accommodating portion 23 after guiding a part of the unrecorded second recording sheet P2 to the placement portion 231 provided below the placement surface 220 of the second accommodating portion 22 with a space. With this configuration, it is possible to prevent the part of the unrecorded second recording sheet P2 from overlapping the first recording sheet P1 and the recorded second recording sheet P2 each on which an image has been recorded, from above in the second accommodating portion 22. This configuration can prevent the user from taking out the unrecorded second recording sheet P2 by mistake, when the user takes out the first recording sheet P1 and the recorded second recording sheet P2, each on which an image has been recorded, from the second accommodating portion 22.

Third Embodiment

Figure 12:
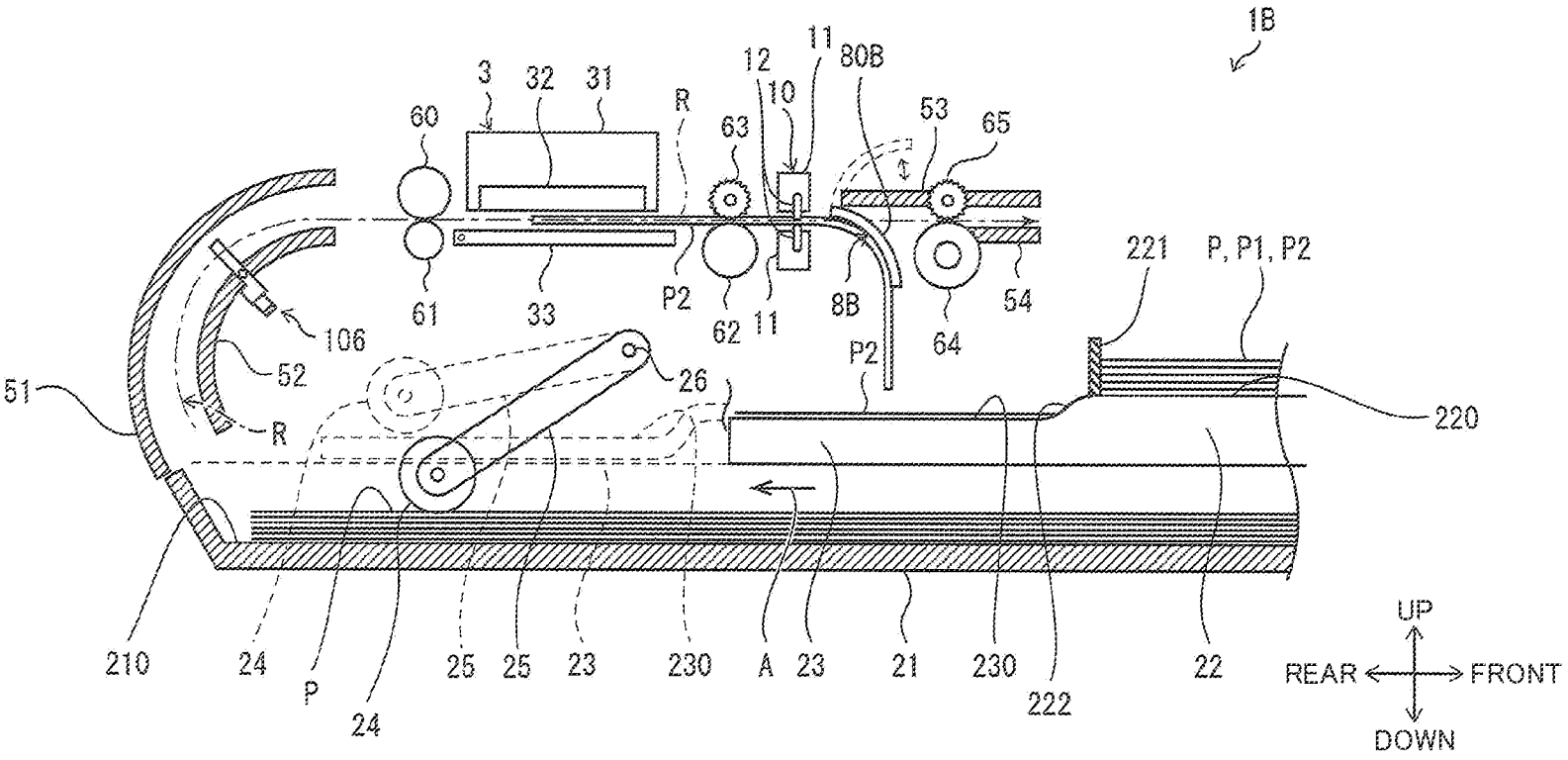
FIG. 12 is a view corresponding to the cross-sectional view in FIG. 2 illustrating a conveyance manner of the recording sheet of the printer according to a third embodiment.

There will be next described, with reference to FIG. 12, a printer 1B according to a third embodiment of the present disclosure. It is noted that the same reference numerals as used in the first embodiment are used to designate the corresponding elements of the third embodiment, and an explanation of which is dispensed with.

Configuration of Printer

FIG. 12 is a cross-sectional view corresponding to the cross-sectional view in FIG. 2 illustrating a conveyance manner of the unrecorded second recording sheet P2 of the printer 1B according to the third embodiment. As illustrated in FIG. 12, in the printer 1B of the third embodiment, shape and operations of a switcher 8B are different from the first embodiment.

The switcher 8B includes a curved portion 80B extending in a direction directed from an upper portion toward a lower portion of the printer 1B and curving toward the second accommodating portion 22. That is, the curved portion 80B curves so as to be nearer to the second accommodating portion 22 at a lower portion of the curved portion 80B than at an upper portion of the curved portion 80B. The switcher 8B is disposed so as to be movable in the up and down direction between the first state defined by a dotted line illustrated in FIG. 12 and the second state defined by a solid line illustrated in FIG. 12.

The switcher 8B guides the first recording sheet P1 and the recorded second recording sheet P2, each on which an image has been recorded, to the second accommodating portion 22 when the switcher 8B is in the first state. On the other hand, as illustrated in FIG. 12, the switcher 8B guides the unrecorded second recording sheet P2 to the third accommodating portion 23 along the curved portion 80B when the switcher 8B is in the second state.

The switcher 8B is connected to a driving mechanism, which is not illustrated. The controller 100 controls driving of the switcher 8B via the driving mechanism to move a position of the switcher 8B between the first state and the second state.

Control Operations of Controller

There will be next described a flow of control in printing by the controller 100 of the printer 1B according to the third embodiment, which are only different points from the first embodiment. In the third embodiment, processings at S8, S9 and S12 in the flowchart in illustrated in FIG. 8 are different from the first embodiment.

In the third embodiment, when it is determined that the second recording sheet P2 is the unrecorded sheet (S7:YES) in the flowchart of FIG. 8, the controller 100, at S8, moves the switcher 8B to the first state indicated by the dotted line in FIG. 12, and conveys the first recording sheet P1 on which an image has been recorded to the second accommodating portion 22 by rotating the first conveying roller 62 and the second conveying roller 64 in the forward direction.

Then, the controller 100, at S9, moves the switcher 8B to the second state indicated by the solid line in FIG. 12, and conveys the unrecorded second recording sheet P2 to the third accommodating portion 23 along the curved portion 80B of the switcher 8B by rotating the first conveying roller 62 in the forward direction.

On the other hand, when it is determined that the second recording sheet P2 is not the unrecorded sheet (S7:NO), that is, when an image has been recorded on the second recording sheet P2, the controller 100, at S12, moves the switcher 8B to the first state, and conveys the first recording sheet P1 and the recorded second recording sheet P2, each on which an image has been recorded, to the second accommodating portion 22 by rotating the first conveying roller 62 and the second conveying roller 64 in the forward direction.

According to the printer 1B of the third embodiment described above, the controller 100 moves the switcher 8B to the first state, and can convey the first recording sheet P1 and the recorded second recording sheet P2, each on which an image has been recorded, to the second accommodating portion 22 by rotating the first conveying roller 62 and the second conveying roller 64 in the forward direction. The controller 100 moves the switcher 8B to the second state, and can convey the unrecorded second recording sheet P2 to the third accommodating portion 23 by rotating the first conveying roller 62 in the forward direction. This configuration enables the printer 1B to switch the conveyance destination of the second recording sheet P2 by a simple configuration without rotating the second conveying roller 64 in the reverse direction.

The switcher 8B provided between the first conveying roller 62 and the second conveying roller 64 enables the third accommodating portion 23 to be disposed at a space below the first conveying roller 62 and the second conveying roller 64. This configuration achieves space saving of the printer 1.

It is noted that, in the third embodiment described above, when it is determined that the second recording sheet P2 is the unrecorded sheet at S7 in FIG. 8 (S7:YES), the controller 100 conveys the first recording sheet P1 to the second accommodating portion 22 (S8), and conveys the unrecorded second recording sheet P2 to the third accommodating portion 23 (S9), however, the present disclosure is not limited to this configuration. For example, the controller 100 may cut the recording sheet P after printing an image on a rear half of the recording sheet P at S4 in FIG. 8. In this case, a front half of the recording sheet P is the unrecorded first recording sheet P1 that has been cut from the recording sheet P and on which an image has not been recorded.

In this case, the controller 100 may determine, at S7, whether the first recording sheet P1 is the unrecorded sheet, and when it is determined that the first recording sheet P1 is unrecorded sheet, the controller 100 may move the switcher 8B to the second state, and may convey the unrecorded first recording sheet P1 to the third accommodating portion 23, and, at S9, may move the switcher 8B to the first state, and may convey the recorded second recording sheet P2 on which an image has been recorded to the second accommodating portion 22. This configuration enables the printer 1 to print an image on the first recording sheet P1 by conveying the first recording sheet P1 accommodated in the third accommodating portion 23 to the image recording device 3 in a next printing.

Other Embodiments

In the printer 1 according to the first embodiment described above, the second accommodating portion 22 and the third accommodating portion 23 are formed in one piece, however, the present disclosure is not limited to this configuration. The second accommodating portion 22 and the third accommodating portion 23 may be formed separately. In this case, only the third accommodating portion 23 is disposed so as to be movable between the first position and the second position in the front and rear direction of the printer 1. That is, the second accommodating portion 22 may be fixed to the frame member 200 of the printer 1, and the third accommodating portion 23 may be disposed so as to be movable with respect to the frame member 200 of the printer 1.

In the printer 1 according to the first embodiment described above, at S23 in FIG. 9, the third accommodating portion 23 is automatically moved from the first position to the second position, the present disclosure is not limited to this configuration. A user may manually move the third accommodating portion 23 from the first position to the second position.

In the printer 1 according to the first embodiment described above, the cutter 10 is disposed downstream of the image recording device 3 in the conveying direction of the recording sheet P, however, the present disclosure is not limited to this configuration. The cutter 10 may be disposed upstream of the image recording device 3 in the conveying direction of the recording sheet P. In this case, the controller 100 records an image on the first recording sheet P1 and the second recording sheet P2 by the image recording device 3 after generating the first recording sheet P1 and the second recording sheet P2 by cutting the recording sheet P by the cutter 10.

In the first embodiment described above, the second accommodating portion 22 is provided with the protruding portion 221, however, the present disclosure is not limited to this configuration. The second accommodating portion 22 may not include the protruding portion 221.

In the first embodiment described above, roller members, that is, the resist roller 60, the first conveying roller 62, and the second conveying roller 64, are used, and convey the recording sheet P, however, the present disclosure is not limited to this configuration. For example, belt members or drum members may be used.

While the embodiments have been described above, it is to be understood that the disclosure is not limited to the details of the illustrated embodiments, but may be embodied with various changes and further modifications, which may occur to those skilled in the art, without departing from the spirit and scope of the disclosure.

What is claimed is:

1. A printer, comprising:

a first accommodating portion that accommodates a recording medium;

a supply roller configured to supply the recording medium to a conveyance path;

a recording device configured to record an image on the recording medium supplied to the conveyance path by the supply roller;

a cutter configured to cut the recording medium into a first recording medium and a second recording medium;

a second accommodating portion that accommodates a recorded first recording medium and a recorded second recording medium, the recorded first recording medium being the first recording medium on which an image has been recorded by the recording device, the recorded second recording medium being the second recording medium on which an image has been recorded by the recording device;

a third accommodating portion that accommodates an unrecorded second recording medium that is the second recording medium on which an image has not been recorded by the recording device; and a switcher configured to switch a conveyance destination of the second recording medium between the second accommodating portion and the third accommodating portion, wherein the third accommodating portion is movable between a first position at which the third accommodating portion receives the unrecorded second recording medium cut by the cutter and a second position at which the unrecorded second recording medium accommodated in the third accommodating portion is in contact with the supply roller, and wherein the supply roller is configured to supply the unrecorded second recording medium accommodated in the third accommodating portion that is positioned at the second position.

2. The printer according to claim 1, wherein the third accommodating portion that is positioned at the second position is nearer to the supply roller than the third accommodating portion that is positioned at the first position.

3. The printer according to claim 1, wherein the switcher is configured to switch the conveyance destination for the recorded second recording medium to the second accommodating portion and switch the conveyance destination for the unrecorded second recording medium to the third accommodating portion that is positioned at the first position.

4. The printer according to claim 1, further comprising:

a moving mechanism configured to move the third accommodating portion; and a controller configured to control driving of the moving mechanism and the supply roller, wherein the controller is configured to move the third accommodating portion from the first position to the second position by driving the moving mechanism, and supply the unrecorded second recording medium accommodated in the third accommodating portion that is positioned at the second position to the conveyance path.

5. The printer according to claim 4, further comprising a third conveying roller disposed at a second-guide-surface side of the switcher and configured to convey the unrecorded second recording medium to the third accommodating portion by rotating in the first direction, wherein the controller is configured to convey the unrecorded second recording medium to the third accommodating portion by rotating the second conveying roller in the second direction and rotating the third conveying roller in the first direction.

6. The printer according to claim 1, further comprising;

a first conveying roller disposed between the recording device and the cutter in the conveyance path and configured to convey the recording medium to the cutter;

a second conveying roller disposed downstream of the cutter in the conveyance path in a conveying direction and configured to convey the recording medium to the second accommodating portion; and a controller configured to control the first conveying roller and the second conveying roller, wherein the switcher includes a first guide surface guiding the recording medium to the second accommodating portion and a second guide surface guiding the unrecorded second recording medium to the third accommodating portion, the first guide surface and the second guide surface being disposed between the first conveying roller and the second conveying roller, and wherein the controller is configured to:

bring the first recording medium and the recorded second recording medium into contact with the first guide surface of the switcher so as to be conveyed to the second accommodating portion by rotating the first conveying roller and the second conveying roller in a first direction, and bring the unrecorded second recording medium into contact with the second guide surface of the switcher so as to be conveyed to the third accommodating portion by rotating the second conveying roller in a second direction that is opposite to the first direction.

7. The printer according to claim 6, wherein the switcher is disposed such that the switcher is rotatable between a first state at which the first guide surface comes into contact with the recording medium and a second state at which the second guide surface comes into contact with the second recording medium.

8. The printer according to claim 7, wherein the third accommodating portion includes a placement portion disposed below a placement surface of the second accommodating portion with a space and on which a part of the unrecorded second recording medium is placed, and wherein the switcher is configured to guide the unrecorded second recording medium to the third accommodating portion after guiding an end of the unrecorded second recording medium to the placement portion.

9. The printer according to claim 1, further comprising:

a first conveying roller disposed between the recording device and the cutter in the conveyance path and configured to convey the recording medium to the cutter;

a second conveying roller disposed downstream of the cutter in the conveyance path in a conveying direction and configured to convey the recording medium to the second accommodating portion; and a controller configured to control the switcher, the first conveying roller and the second conveying roller, wherein the switcher is disposed between the first conveying roller and the second conveying roller and switchable between a first state in which the switcher guides each of the recorded first recording medium and the recorded second recording medium to the second accommodating portion and a second state in which the switcher guides the unrecorded second recording medium to the third accommodating portion, and wherein the controller is configured to:

convey the recorded first recording medium and the recorded second recording medium to the second accommodating portion by rotating the first conveying roller and the second conveying roller in the first direction in a state in which the switcher is in the first state, and convey the unrecorded second recording medium to the third accommodating portion by rotating the first conveying roller in the first direction in a state in which the switcher is in the second state.

10. The printer according to claim 1, wherein the second accommodating portion and the third accommodating portion are disposed so as not to overlap each other when viewed from above the printer in a vertical direction.

11. The printer according to claim 1, wherein the second accommodating portion includes a placement surface on which the recorded first recording medium and the recorded second recording medium are placed, and a protruding portion protruding upward from at least a first edge of the placement surface that is nearer to the third accommodating portion than a second edge of the placement surface.

12. The printer according to claim 1, further comprising:

a controller configured to control the supply roller; and a receiver configured to receive a job, wherein the controller is configured to:

in a case where a total number of printing pages designated by the received job is an even number, control the supply roller to supply the recording medium accommodated in the first accommodating portion to the conveyance path, and in a case where (a) a total number of printing pages designated by the received job is an odd number, and (b) there is the unrecorded second recording medium in the third accommodating portion, control the supply roller to supply the unrecorded second recording medium to the conveyance path when an image corresponding to the first page or the last page of printing pages is recorded, and control the supply roller to supply the recording medium accommodated in the first accommodating portion to the conveyance path when images corresponding to pages of printing pages other than the first page or the last page are recorded.

13. The printer according to claim 1, wherein the third accommodating portion is disposed below the switcher, and wherein the switcher includes a curved portion as one of (a) a first curved portion curving so as to be nearer to the cutter at a lower portion of the first curved portion than at a upper portion of the first curved portion, and (b) a second curved portion curving so as to be nearer to the second accommodating portion at a lower portion of the second curved portion than at an upper portion of the second curved portion, the curved portion guiding the unrecorded second recording medium to the third accommodating portion along the curved portion.

14. The printer according to claim 1, further comprising:

a storage storing information relating to the printer; and a recording medium sensor configured to detect whether the unrecorded second recording medium exists in the third accommodating portion, wherein, when a power of the printer is turned off, the storage stores the information related to an existence and a nonexistence of the unrecorded second recording medium detected by the recording medium sensor.

15. The printer according to claim 1, wherein a dimension of the third accommodating portion in a depth direction is less than a dimension of the first accommodating portion in the depth direction.

16. The printer according to claim 1, wherein the third accommodating portion is disposed above the first accommodating portion.

17. The printer according to claim 1, wherein the third accommodating portion is disposed so as to be slidable between the first position and the second position along an upper wall of the first accommodating portion.

18. The printer according to claim 1, wherein the third accommodating portion accommodates the second recording medium so as not to come into contact with the supply roller when positioned at the first position.

19. The printer according to claim 1, wherein the second accommodating portion and the third accommodating portion are formed in one piece and disposed so as not to overlap each other when viewed from above the printer in a vertical direction, and wherein a step is formed between the second accommodating portion and the third accommodating portion.

* * * * *